US010326248B2

(12) United States Patent
Li

(10) Patent No.: US 10,326,248 B2
(45) Date of Patent: Jun. 18, 2019

(54) TERMINAL CRIMP TOOL

(71) Applicant: Yu-Hsin Li, Changhua County (TW)

(72) Inventor: Yu-Hsin Li, Changhua County (TW)

( * ) Notice: Subject to any disclaimer, the term of this patent is extended or adjusted under 35 U.S.C. 154(b) by 183 days.

(21) Appl. No.: 15/233,014

(22) Filed: Aug. 10, 2016

(65) Prior Publication Data

US 2018/0048106 A1 Feb. 15, 2018

(51) Int. Cl.
*H01R 43/042* (2006.01)
*B25B 27/14* (2006.01)

(52) U.S. Cl.
CPC ..... *H01R 43/042* (2013.01); *B25B 27/146* (2013.01); *Y10T 29/53226* (2015.01)

(58) Field of Classification Search
CPC ..... H01R 43/048; H01R 43/058; H01R 43/042–43/0585; B25B 9/00; B25B 7/00; B25B 1/20; B25B 1/2426; B25B 1/2452; B25B 1/106; B25B 1/18; B25B 1/22; B25B 1/2457; B25B 5/006; B25B 27/146; B25B 7/02; B25B 7/04; Y10T 29/53226; Y10T 29/539; Y10T 29/53996; Y10T 29/53235; Y10T 29/49826
USPC ..... 29/402.09, 596, 896.6, 902, 751, 237, 29/268, 566.1, 709, 750, 753, 758; 439/66, 6
See application file for complete search history.

(56) References Cited

U.S. PATENT DOCUMENTS 4,707,913 A * 11/1987 Moline ..... H01R 43/048 29/566.2
5,012,666 A * 5/1991 Chen ..... H01R 43/042 29/751
5,289,712 A * 3/1994 Haughian ..... B25B 7/12 29/237
5,680,788 A * 10/1997 Kootte ..... B25B 7/126 72/452.8
7,424,838 B2 * 9/2008 Li ..... B25B 7/22 7/129

OTHER PUBLICATIONS

Nee, John G.. (2010). Fundamentals of Tool Design (6th Edition)—5.6.1 Plate Jig Design Example. Society of Manufacturing Engineers (SME). FundamentalofToolDesign_Front.*
Nee, John G.. (2010). Fundamentals of Tool Design (6th Edition)—5.6.1 Plate Jig Design Example. Society of Manufacturing Engineers (SME). FundamentalofToolDesign_descriptions (Chapter 5).*

* cited by examiner

*Primary Examiner* — Thiem D Phan
(74) *Attorney, Agent, or Firm* — Rosenberg, Klein & Lee

(57) ABSTRACT

A terminal crimp tool includes a first unit, a second unit, a third unit, multiple reinforcement rings, multiple pins and multiple C-clips. The first, second and third units are pivotably connected to each other by the restriction unit. The first, second and third units each have a pivotal hole defined in overlapped positions, and each pivotal hole is forcibly fitted with one reinforcement ring to reinforce the strength of the plates of the first, second and third units. The pins extend through the plates of the first, second and third units to ensure that the first, second and third units are pivoted smoothly and precisely so as to deform the terminals of wires or cables.

2 Claims, 8 Drawing Sheets

TERMINAL CRIMP TOOL

BACKGROUND OF THE INVENTION

1. Fields of the Invention

The present invention relates to a hand tool, and more particularly, to a terminal crimp tool.

2. Descriptions of Related Art

The conventional terminal crimp tools comprise two parts which are pivotably connected each other, and each part has a handle on one end and a crimp portion on the other end. The crimp portion of one part includes multiple recesses and the crimp portion of the other part has multiple protrusions. The terminals are usually a metal tube and wires are restricted in the terminals. The terminals are located between the two crimp portions and the user hold and squeeze the handles toward each other to crimp the terminals which are deformed so that the wires are not disengage from the terminals. The terminals are then connected with other appliances or electric parts.

A conventional terminal crimp tool known to applicant comprises two parts which are pivotably connected each other, and each part has a handle on one end and a crimp portion on the other end. The crimp portion of one part includes multiple recesses and the crimp portion of the other part has multiple protrusions. The two parts are made by iron which is heavy and difficult to be machined. In order to reduce the weight problem, some crimp tools are made of aluminum. Nevertheless, the aluminum cannot bear high pressure and torque so that when operating the crimp tool, the crimp portions may be deformed.

The present invention intends to provide a terminal crimp tool which is light in weight while the structural strength is strong enough so as to eliminate the shortcomings mentioned above.

SUMMARY OF THE INVENTION

The present invention relates to a terminal crimp tool and comprises a first unit, a second unit and a third unit. Each of the first, second and third units has two plates, wherein the two plates of the first unit are spaced apart from each other, and the two plates of the third unit are spaced apart from each other. Two respective first ends of the two plates of the second unit are overlapped with each other. A portion of the overlapped first ends of two plates of the second unit is partially inserted between the two plates of the first unit, and another portion of the overlapped first ends of two plates of the second unit is partially exposed from the first unit and inserted between the two plates of the third unit. Two respective second ends of the two plates of the second unit are bent outward and spaced apart from each other. The first unit is pivotably connected to the second unit. Each of the first and second units has a driving end and a handle end, and a plastic grip is mounted to each of the two respective handle ends. Two blocks are respectively connected to the two respective driving ends of the first and second units, and each of the two blocks has recesses and protrusions which are located alternatively between the recesses. The protrusions of one of the two blocks are located corresponding to recesses of the other one of the two blocks.

A restriction unit is located between the plates of the first, second and third units. Each of the plates has a pivotal hole defined in a position where the plates are overlapped to each other, and another pivotal hole is defined in a position where the plates of the first and third units are overlapped to the restriction unit. The restriction unit has a first link, a second link, a control member, a first spring and a second spring, wherein the first and second links are overlapped to each other and located between the first and third units. At least two of multiple pins extend through the first and second units and the first and second links. The second link has a toothed portion formed on the first end thereof which is located between the two plates of the third unit. The second end of the second link is located between the two plates of the first unit and connected with the first end of the first spring. The second end of the first spring is connected to the first rod located between the two plates of the first unit. The control member is located between the two plates of the third unit. One of the at least two pins extends through the control member. The control member has a lever, a pawl and an engaging portion. The lever extends beyond the third unit. The pawl is engaged with the toothed portion when the first unit moves toward the third unit. The engaging portion is connected to the first end of the second spring, and the second end of the second spring is connected to the second rod located between the two plates of the third unit.

Multiple reinforcement rings are respectively and force-fitted into the pivotal holes so as to reinforce the strength of the plate. The outer diameter of each of the reinforcement rings is larger than the inner diameter of each of the pivotal holes. The hardness of each of the reinforcement rings is larger than that of each of the plates.

Multiple pins respectively extend through the reinforcement rings. Each pin has a groove defined in the outer periphery of each of two ends thereof. A C-clip is engaged with each of the grooves of the pins and contacts the plate corresponding thereto so as to ensure smooth pivotal movement of the first, second and third units.

Preferably, each of the reinforcement rings has an inner face, an outer face and two end faces. Each reinforcement ring has the outer diameter defined as "H", and the inner diameter of each of the pivotal holes is defined as "D", wherein "H" is larger than "D". When each of the multiple reinforcement rings is force-fitted into the pivotal hole corresponding thereto, the radius of the outer face is reduced a distance of (H−D)/2. The outer face contacts against the inner periphery of the pivotal hole.

Preferably, the C-clips each have an opening and a stud which protrudes from the inner periphery of the C-clip and is engaged with the groove of the pin corresponding thereto.

The advantages of the present invention are that the reinforcement rings are force-fitted into the pivotal holes of the first, second and third units so as to increase the strength of the plates which are able to bear higher force to prevent from being deformed.

The use of the pins help the reinforcement rings to strengthen the plates, and the force-fitted relationship between the reinforcement rings and the pins not only reinforces the reinforcement rings, and also prevents the three units from being disassembled from each other.

The plastic grips provide sufficient friction for the users to hold the tool comfortably.

The hardness of the plates is less than that of the reinforcement rings and the pins so that the total weight of the tool is reduced while the strength is sufficiently high.

The present invention will become more apparent from the following description when taken in connection with the accompanying drawings which show, for purposes of illustration only, a preferred embodiment in accordance with the present invention.

DETAILED DESCRIPTION OF THE PREFERRED EMBODIMENT

Figure 1:
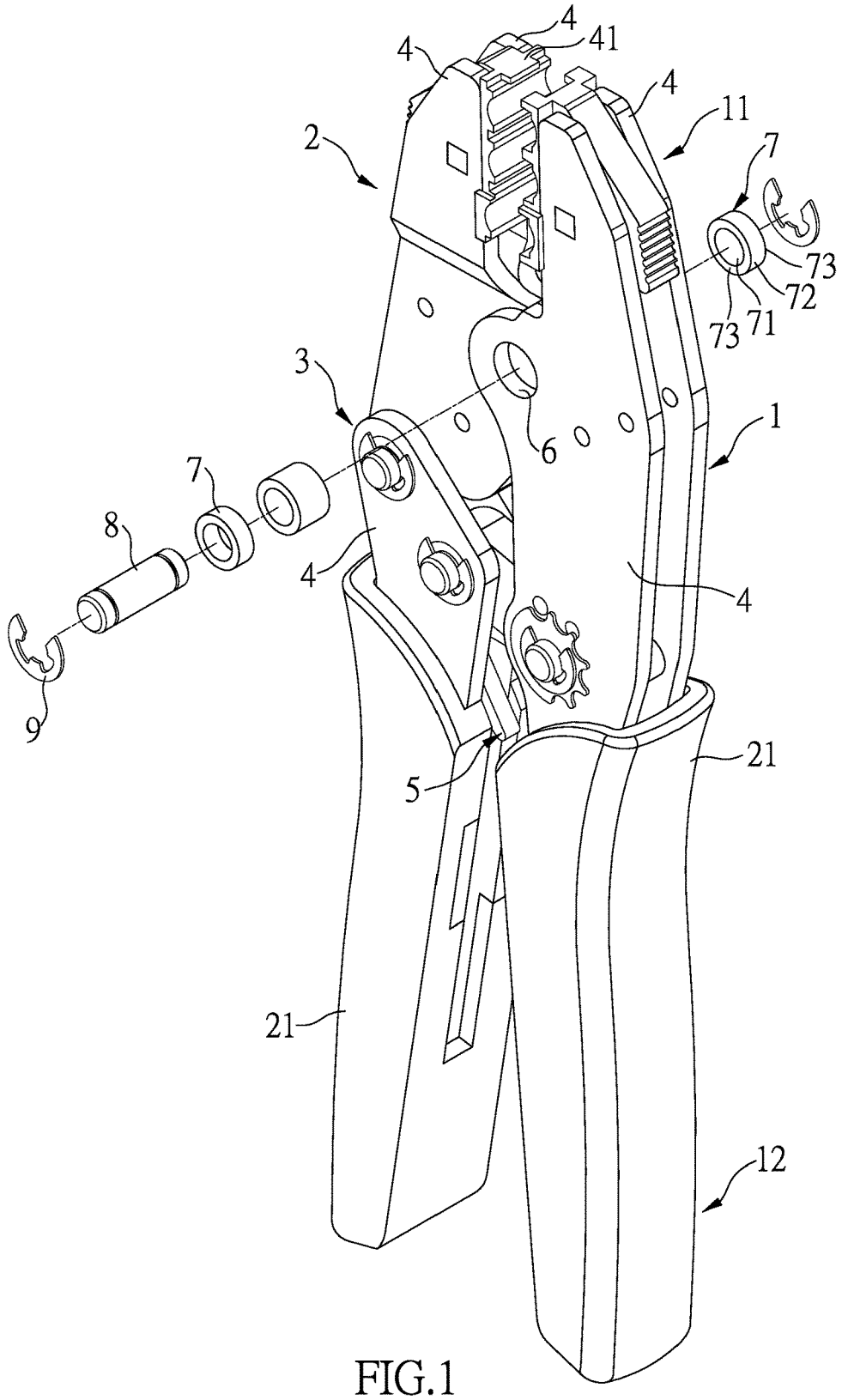
FIG. 1 is a partially exploded view of the terminal crimp tool of the present invention.
Figure 2:
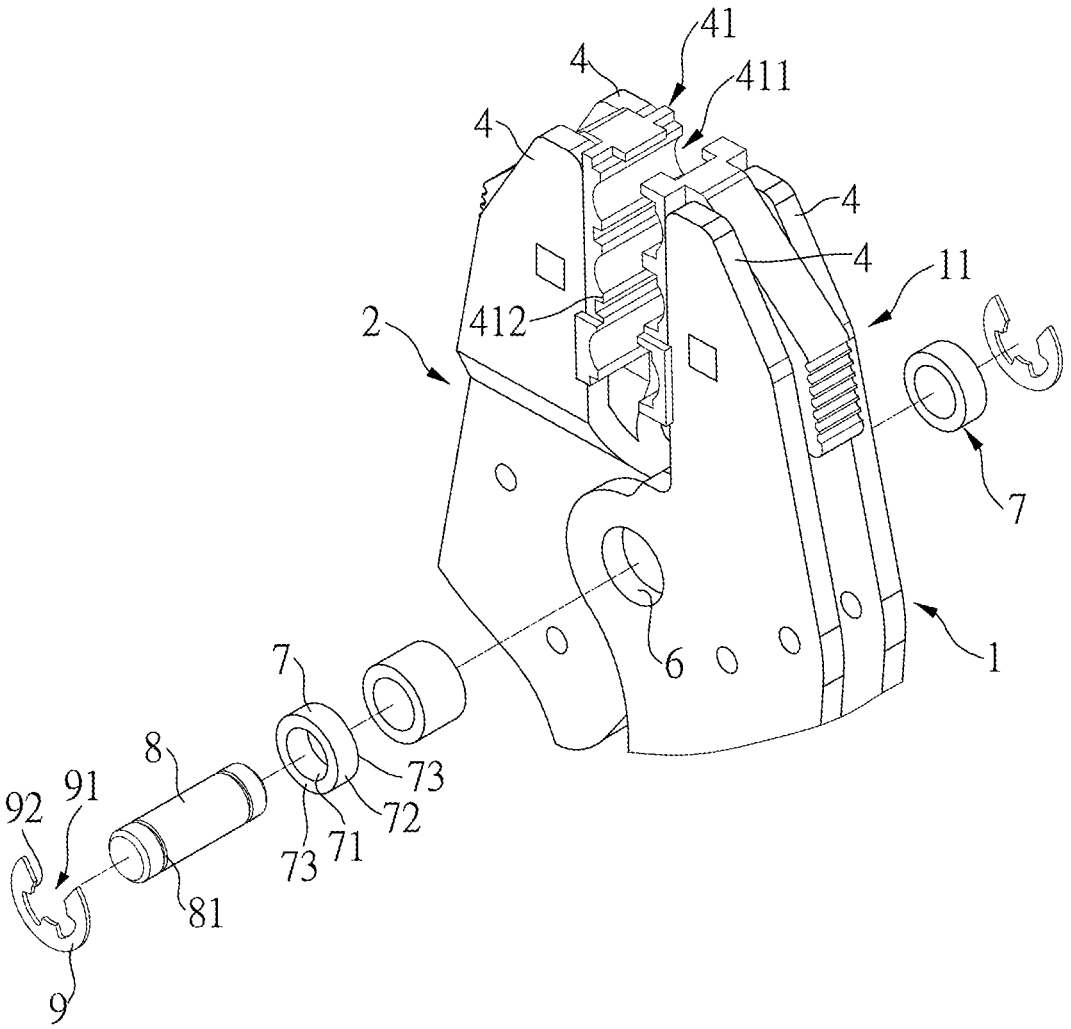
FIG. 2 is an enlarged view to show a portion of FIG. 1.
Figure 3:
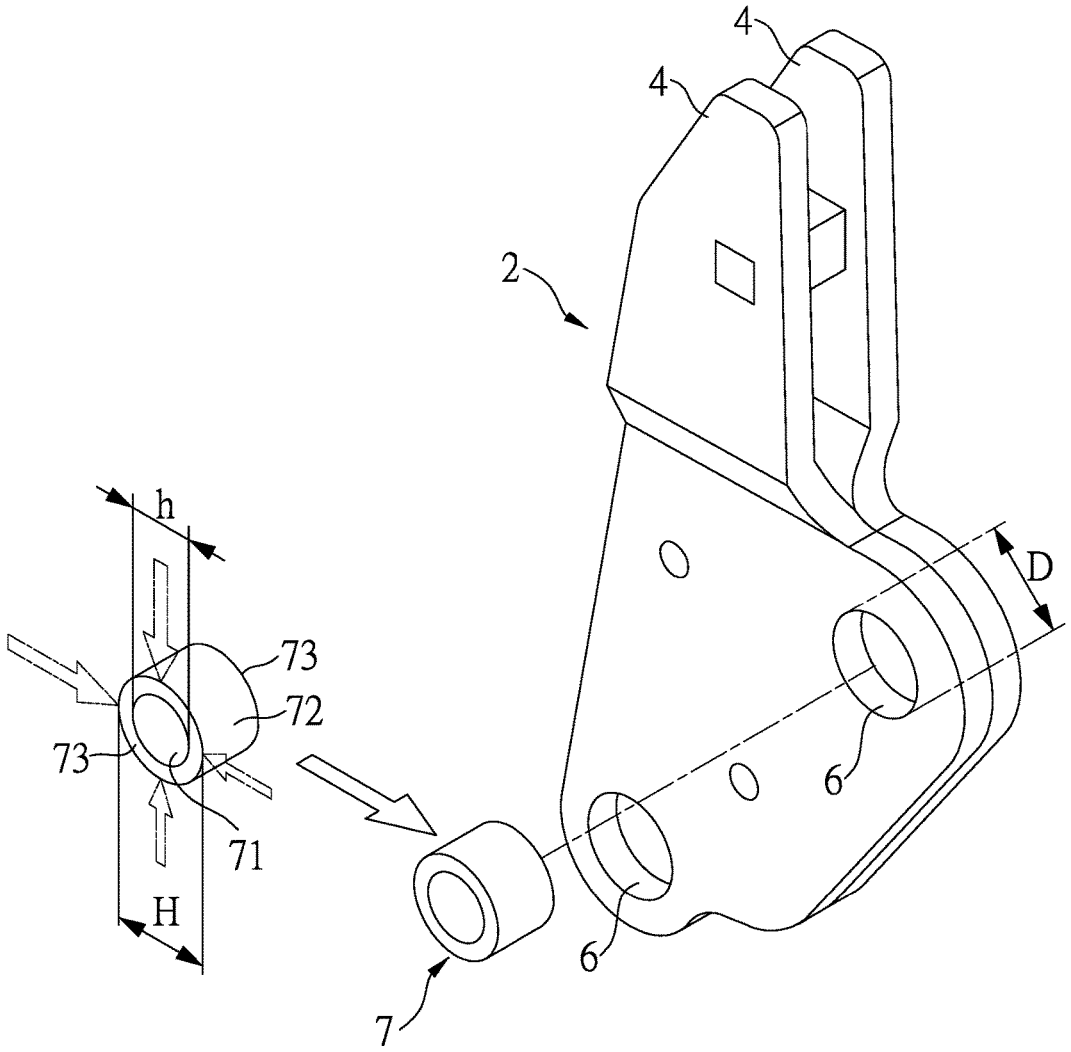
FIG. 3 shows the size description of the reinforcement ring and the pivotal hole of the terminal crimp tool of the present invention.
Figure 4:
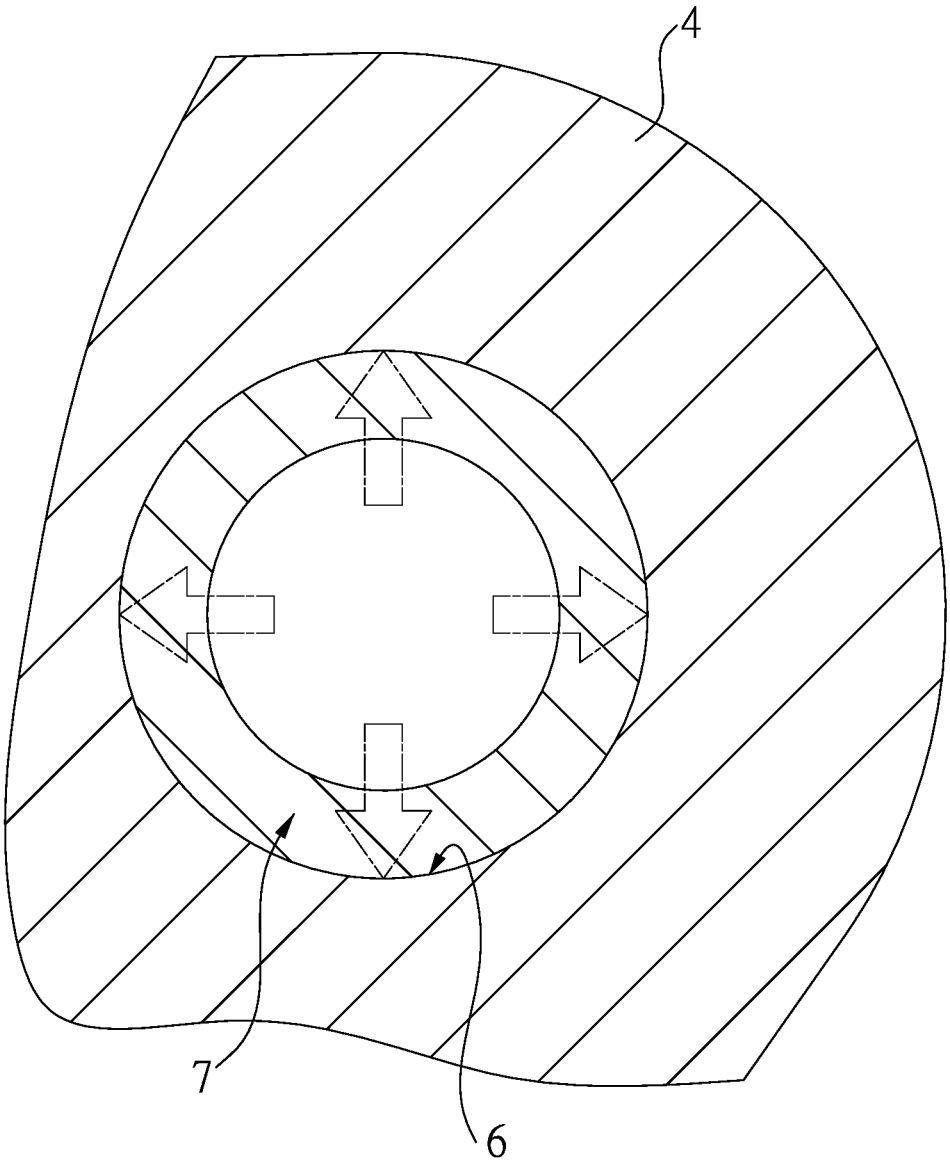
FIG. 4 is a cross sectional view to show that the reinforcement ring is force-fitted into the pivotal hole.
Figure 5:
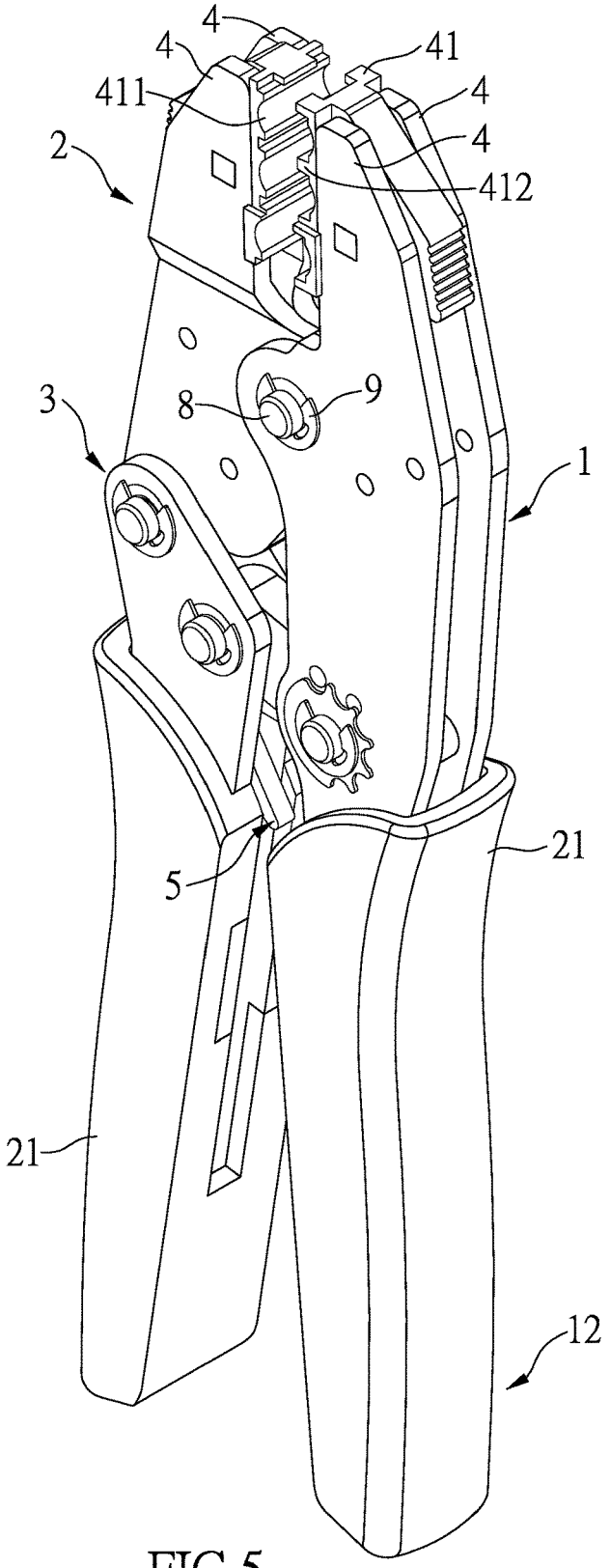
FIG. 5 is a perspective view to show the terminal crimp tool of the present invention.
Figure 6:
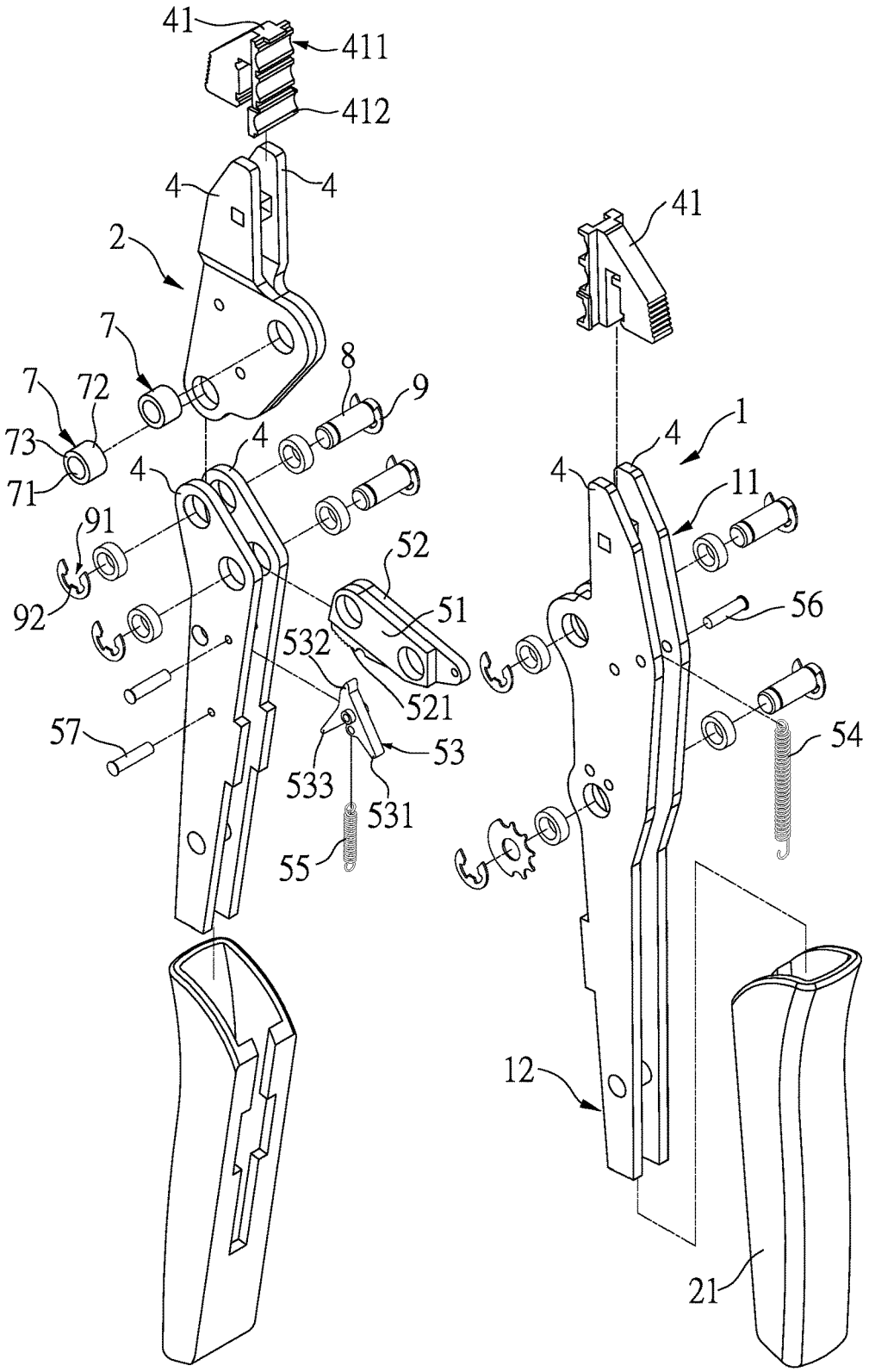
FIG. 6 is an exploded view of the terminal crimp tool of the present invention.
Figure 7:
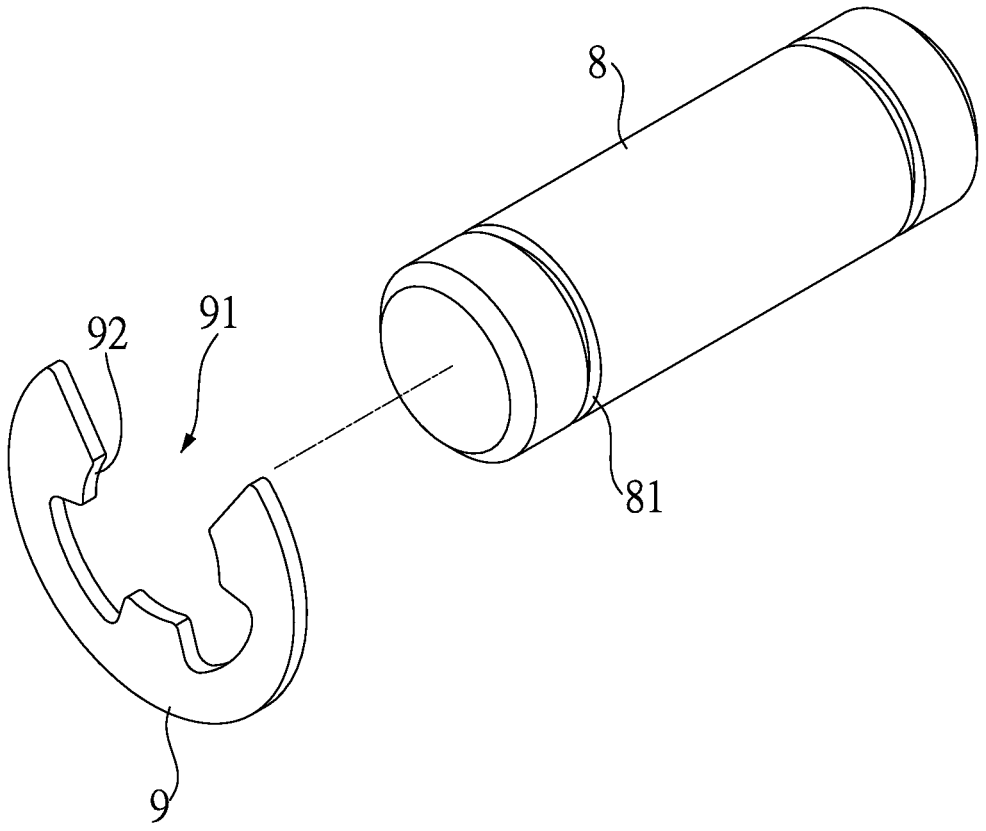
FIG. 7 shows the pin and the C-clip of the terminal crimp tool of the present invention.
Figure 8:
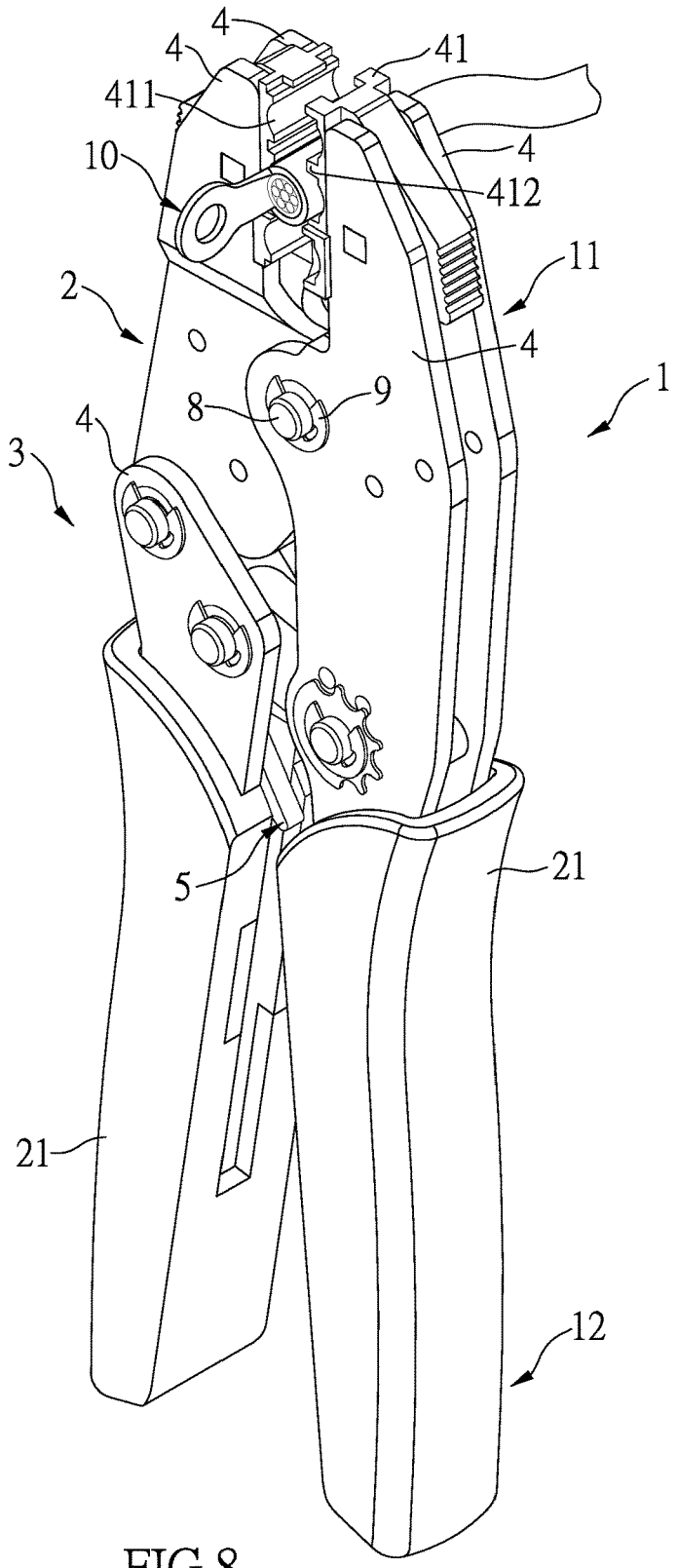
FIG. 8 shows that the terminal crimp tool of the present invention is used to crimp a terminal of a cable.

Referring to FIGS. 1 to 8, the terminal crimp tool of the present invention comprises a first unit 1, a second unit 2 and a third unit 3. Each of the first, second and third units 1, 2, 3 has two plates 4. The two plates 4 of the first unit 1 are spaced apart from each other, and the two plates 4 of the third unit 3 are spaced apart from each other. Two respective first ends of the two plates 4 of the second unit 2 are overlapped with each other. A portion of the overlapped first ends of two plates 4 of the second unit 2 is partially inserted between the two plates of the first unit 1, and another portion of the overlapped first ends of two plates 4 of the second unit 2 is partially exposed from the first unit 1 and inserted between the two plates 4 of the third unit 3. Two respective second ends of the two plates 4 of the second unit 2 are bent outward and spaced apart from each other. The first unit 1 is pivotably connected to the second unit 2. Each of the first and second units 1, 2 has a driving end 11 and a handle end 12 respectively formed on two ends thereof. A plastic grip 21 is mounted to each of the two respective handle ends 12. Two blocks 41 are respectively connected to the two respective driving ends 11 of the first and second units 1, 2, wherein each of the two blocks 41 has recesses 411 and protrusions 412 which are located alternatively between the recesses 411. The protrusions 412 of one of the two blocks 41 is located corresponding to recesses 411 of the other one of the two blocks 41.

A restriction unit 5 is located between the plates 4 of the first, second and third units 1, 2, 3. Each of the plates 4 has a pivotal hole 6 defined in a position where the plates 4 are overlapped to each other. Another pivotal hole 6 is defined in a position where the plates 4 of the first and third units 1, 3 are overlapped to the restriction unit 5.

The restriction unit 5 includes a first link 51, a second link 52, a control member 53, a first spring 54 and a second spring 55. The first and second links 51, 52 are overlapped to each other and located between the first and third units 1, 3. Multiple reinforcement rings 7 are respectively and force-fitted into the pivotal holes 6 so as to reinforce the strength of the plate 4. The outer diameter of each of the reinforcement rings 7 is larger than the inner diameter of each of the pivotal holes 6. The hardness of each of the reinforcement rings 7 is larger than that of each of the plates 4. Multiple pins 8 respectively extend through the reinforcement rings 7. Each pin 8 has a groove 81 defined in the outer periphery of each of two ends thereof. A C-clip 9 is engaged with each of the grooves 81 of the pins 8 and contacts the plate 4 corresponding thereto so as to ensure smooth pivotal movement of the first, second and third units 1, 2, 3.

The reinforcement rings 7 are force-fitted into the pivotal holes 6 of the first, second and third units 1, 2, 3 so as to increase the strength of the plates 4 which are able to bear higher force to prevent from being deformed. The use of the pins 8 help the reinforcement rings 7 to strengthen the plates 4, and the force-fitted relationship between the reinforcement rings 7 and the pins 8 reinforces the reinforcement rings 7, and prevents the three units 1, 2, 3 from being disassembled from each other, such that the terminals 10 of cables can be deformed when using the terminal crimp tool of the present invention.

Generally, when crimping the terminals 10, the pivotal portions of the plates 4 have to bear a high torque and force, and the reinforcement rings 7 are force-fitted into the pivotal holes 6 to effectively strengthen the plates 4 to bear a higher torque and force.

It is noted that each of the reinforcement rings 7 has an inner face 71, an outer face 72 and two end faces 73. Each reinforcement ring 7 has the outer diameter defined as "H", and the inner diameter of each of the pivotal holes 6 is defined as "D", wherein "H" is larger than "D". When each of the multiple reinforcement rings 7 is force-fitted into the pivotal hole 6 corresponding thereto by using a proper tool, the outer face 72 is reduced a distance of (H−D)/2, and the outer face 72 contacts against the inner periphery of the pivotal hole 6. Therefore, the reinforcement rings 7 do not drop from the pivotal holes 6, and the plates 4 will not dis-assembled from each other.

The C-clips 9 each have an opening 91 and at least one stud 92 which protrudes from the inner periphery of the C-clip 9 and is engaged with the groove 81 of the pin 8 corresponding thereto. In this embodiment, each C-clip 9 has three studs 92 wherein two of the studs 92 are formed on two ends of the opening 91, and the third stud 92 is located at the even distance from the two studs 92 that are formed on the two ends of the opening 91. The studs 92 are engaged with the grooves 81 and the C-clips contact against the plates 4 corresponding thereto so as to prevent the pins 8 from shifting in the reinforcement rings 7. Therefore, the first, second and third units 1, 2, 3 are not separated from each other. The use of the reinforcement rings 7, the pins 8 and the C-clip 9 strengthen the plates 4 and ensures that the terminal crimp tool is operated smoothly.

Specifically, the restriction unit 5 includes the first link 51, the second link 52, the control member 53, the first spring 54 and the second spring 55. The first and second links 51, 52 are overlapped to each other and located between the first and third units 1, 3. At least two pins 8 extend through the first and second units 1, 2 and the first and second links 51, 52. The second link 52 has a toothed portion 521 formed on the first end thereof which is located between the two plates 4 of the third unit 3. The second end of the second link 52 is located between the two plates 4 of the first unit 1 and connected with the first end of the first spring 54. The second end of the first spring 54 is connected to a first rod 56 located between the two plates 4 of the first unit 1. The control member 53 is located between the two plates 4 of the third unit 3. One of the at least two pins 8 extends through the control member 53. The control member 53 has a lever 531, a pawl 532 and an engaging portion 533. The lever 531 extends beyond the third unit 3. The pawl 532 is engaged with the toothed portion 521 when the first unit 1 moves toward the third unit 3. The engaging portion 533 is connected to the first end of the second spring 55, and the second end of the second spring 55 is connected to a second rod 57 located between the two plates 4 of the third unit 3. When in use, the user pivots the handle ends 12 to move the first and third units 1, 3 toward each other, by the first and second springs 54, 55, and the engagement between the toothed portion 521 and the pawl 532, the distance between the first and third units 1, 3 is properly controlled. The terminal 10 is located between the two blocks 41 and deformed when the two blocks 41 are moved toward each other, such that the wires in the terminal 10 are firmly restricted in the deformed terminal 10.

After the terminal 10 is deformed, the first and third units 1, 3 are released, the first and third units 1, 3 return to their initial positions. When folding the crimp tool, the two handle ends 12 are moved toward each other, and the pawl 532 is engaged with the toothed portion 521 of the second link 53 to maintain the crimp tool at the folded status. When using the crimp tool, further moving the two handle ends 12 toward each other to disengage the pawl 532 from the toothed portion 521, the first and third units 1, 3 are separated from each other.

The hardness of the plates 4 is less than that of the reinforcement rings 7 and the pins 8 so that the total weight of the tool is reduced while the strength is sufficiently strong.

While we have shown and described the embodiment in accordance with the present invention, it should be clear to those skilled in the art that further embodiments may be made without departing from the scope of the present invention.

What is claimed is:

1. A terminal crimp tool comprising:

a first unit, a second unit and a third unit, each of the first, second and third units having two plates, the two plates of the first unit being spaced apart from each other, the two plates of the third unit being spaced apart from each other, two respective first ends of the two plates of the second unit being overlapped with each other, a portion of the overlapped first ends of two plates of the second unit partially inserted between the two plates of the first unit, another portion of the overlapped first ends of two plates of the second unit partially exposed from the first unit and inserted between the two plates of the third unit, two respective second ends of the two plates of the second unit bent outward and spaced apart from each other, the first unit being pivotably connected to the second unit, each of the first and second units having a driving end and a handle end, a plastic grip mounted to each of the two respective handle ends, two blocks respectively connected to the two respective driving ends of the first and second units, each of the two blocks having recesses and protrusions which are located alternatively between the recesses, the protrusions of one of the two blocks being located corresponding to recesses of the other one of the two blocks;

a restriction unit located between the plates of the first, second and third units, each of the plates having a pivotal hole defined in a position where the plates are overlapped to each other, another pivotal hole defined in a position where the plates of the first and third units are overlapped to the restriction unit, the restriction unit having a first link, a second link, a control member, a first spring and a second spring, the first and second links being overlapped to each other and located between the first and third units, at least two of multiple pins extending through the first and second units and the first and second links, the second link having a toothed portion formed on a first end thereof which is located between the two plates of the third unit, a second end of the second link located between the two plates of the first unit and connected with a first end of the first spring, a second end of the first spring connected to a first rod located between the two plates of the first unit, the control member located between the two plates of the third unit, one of the at least two pins extending through the control member, the control member having a lever, a pawl and an engaging portion, the lever extending beyond the third unit, the pawl engaged with the toothed portion when the first unit moves toward the third unit, the engaging portion connected to a first end of the second spring, a second end of the second spring connected to a second rod located between the two plates of the third unit;

multiple reinforcement rings respectively and force-fitted into the pivotal holes so as to reinforce strength of the plates, an outer diameter of each of the reinforcement rings being larger than an inner diameter of each of the pivotal holes, a hardness of each of the reinforcement rings being larger than that of each of the plates, each of the reinforcement rings having an inner face, an outer face and two end faces, each reinforcement ring having the outer diameter defined as "H", the inner diameter of each of the pivotal holes being defined as "D", "H" being larger than "D", when each of the multiple reinforcement rings is force-fitted into the pivotal hole corresponding thereto, a radius of the outer face is reduced a distance of (H−D)/2, the outer face contacts against the inner periphery of the pivotal hole, and the multiple pins respectively extending through the reinforcement rings, each pin having a groove defined in an outer periphery of each of two ends thereof, a C-clip engaged with each of the grooves of the pins and contacting the plate corresponding thereto so as to ensure pivotal movement of the first, second and third units.

2. The terminal crimp tool as claimed in claim 1, wherein the C-clips each have an opening and a stud which protrudes from an inner periphery of the C-clip and is engaged with the groove of the pin corresponding thereto.

* * * * *